United States Patent [19]

Shikanai

[11] Patent Number: 4,971,464

[45] Date of Patent: Nov. 20, 1990

[54] DOT SERIAL PRINTER

[75] Inventor: Naoki Shikanai, Owariasahi, Japan

[73] Assignee: Hitachi, Ltd., Tokyo, Japan

[21] Appl. No.: 448,439

[22] Filed: Feb. 27, 1990

Related U.S. Application Data

[63] Continuation of Ser. No. 190,154, May 4, 1988, abandoned, which is a continuation of Ser. No. 927,139, Nov. 5, 1986, abandoned.

[30] Foreign Application Priority Data

Nov. 5, 1985 [JP] Japan ..... 60-246159

[51] Int. Cl.[5] ..... B41J 19/30

[52] U.S. Cl. ..... 400/323; 400/121

[58] Field of Search ..... 400/121, 323, 902, 903; 101/93.04

[56] References Cited

U.S. PATENT DOCUMENTS

| | | | |
|---|---|---|---|
| 4,119,383 | 10/1978 | Watanabe | 400/320 |
| 4,693,618 | 9/1987 | Hanagata | 400/903 |

FOREIGN PATENT DOCUMENTS

| | | | |
|---|---|---|---|
| 22059 | 2/1982 | Japan | 400/323 |
| 8681 | 1/1983 | Japan | 400/903 |
| 163685 | 9/1983 | Japan | 400/323 |
| 124880 | 7/1984 | Japan | 400/323 |
| 168681 | 9/1985 | Japan | 400/323 |

OTHER PUBLICATIONS

Cenbronics Model 351 Printer Technical Manual, Apr. 1984.

*Primary Examiner*—David A. Wiecking

*Attorney, Agent, or Firm*—Antonelli, Terry, Stout & Kraus

[57] ABSTRACT

In a dot serial printer suitable for bidirectional printing of enlarged letters and the like, a signal for starting printing is produced with a time delay of m/n times the dot drive period relative to a signal produced in synchronism with a motor control timing in advance of commencement of printing to thereby promote print quality of the enlarged letters and the like.

2 Claims, 4 Drawing Sheets

200

| m | TIMER VALUE |
|---|---|
| 0 | 0 |
| 1 | To / n |
| 2 | 2To / n |
| ... | ... |
| n-2 | (n-2)To/n |
| n-1 | (n-1)To/n |

DOT SERIAL PRINTER

This application is a continuation of application Ser. No. 190,154, filed May 4, 1988, which is a continuation of application Ser. No. 927,135, filed Nov. 5, 1986, both now abandoned.

BACKGROUND OF THE INVENTION

This invention generally relates to a print control system and more particularly to a print control system suitable for improving accuracy of aligning portions of a vertical rule or portions of a vertically enlarged letter and thus promoting print quality when these portions are printed bidirectionally.

When portions of a vertical rule extending across a plurality of lines or portions of a vertically enlarged letter extending across two lines are printed bidirectionally, conventional printers inevitably suffer from a displacement or misalignment of printing position between a portion on the preceding line and another portion on the succeeding line because a conveying mechanism for a printing head has a mechanical factor such as backlash. Conventionally, to correct the misalignment, the timing for commencement of printing in the positive or negative direction is controlled for acceleration or retardation by using, for example, a microprogram. The conventional control for the purpose of correction of the printing position is however performed solely in a unit of dot pitch with the result that the correction is invalidated for an amount of misalignment being smaller than half the dot pitch. Accordingly, when portions of a vertical rule or a vertically enlarged letter are printed bidirectionally, accuracy of alignment is impaired and print quality is degraded. To improve print quality, printing is therefore performed unidirectionally at the cost of throughput in printing for documents containing vertical rules and vertically enlarged letters.

When viewing with the naked eye, degradation in print quality may be intuited when there occurs a displacement of about 0.07 mm or more for a dot diameter of 0.2 mm and a dot pitch of 1/180 inches, the displacement amounting to half the dot pitch at the minimum.

A relevant printer of this type is disclosed in, for example, JP-A-55-37653.

SUMMARY OF THE INVENTION

An object of this invention is to provide a print control system which can permit accurate bidirectional printing for a document containing a vertical rule and/or a vertically enlarged letter by reducing the amount of misalignment between portions of the vertical rule or vertically enlarged letter to half the dot pitch or less when these portions are printed bidirectionally, thereby promoting throughput in printing.

Considering that print quality can be promoted in bidirectional printing for documents containing vertical rules and/or vertically enlarged letters by making it possible to correct printing position in a unit which is smaller than the dot pitch in contrast to the conventional print controlling wherein correction of the printing position is performed solely in a unit of dot pitch, the present invention ensures that, in at least either of a positive directional printing or a negative directional printing, the timing for commencement of printing can be retarded in a unit of 1/n of the dot drive period to change the printing position in a unit of 1/n of the dot pitch.

DESCRIPTION OF THE PREFERRED EMBODIMENTS

The invention will now be described by way of example with reference to the accompanying drawings.

Figure 1:
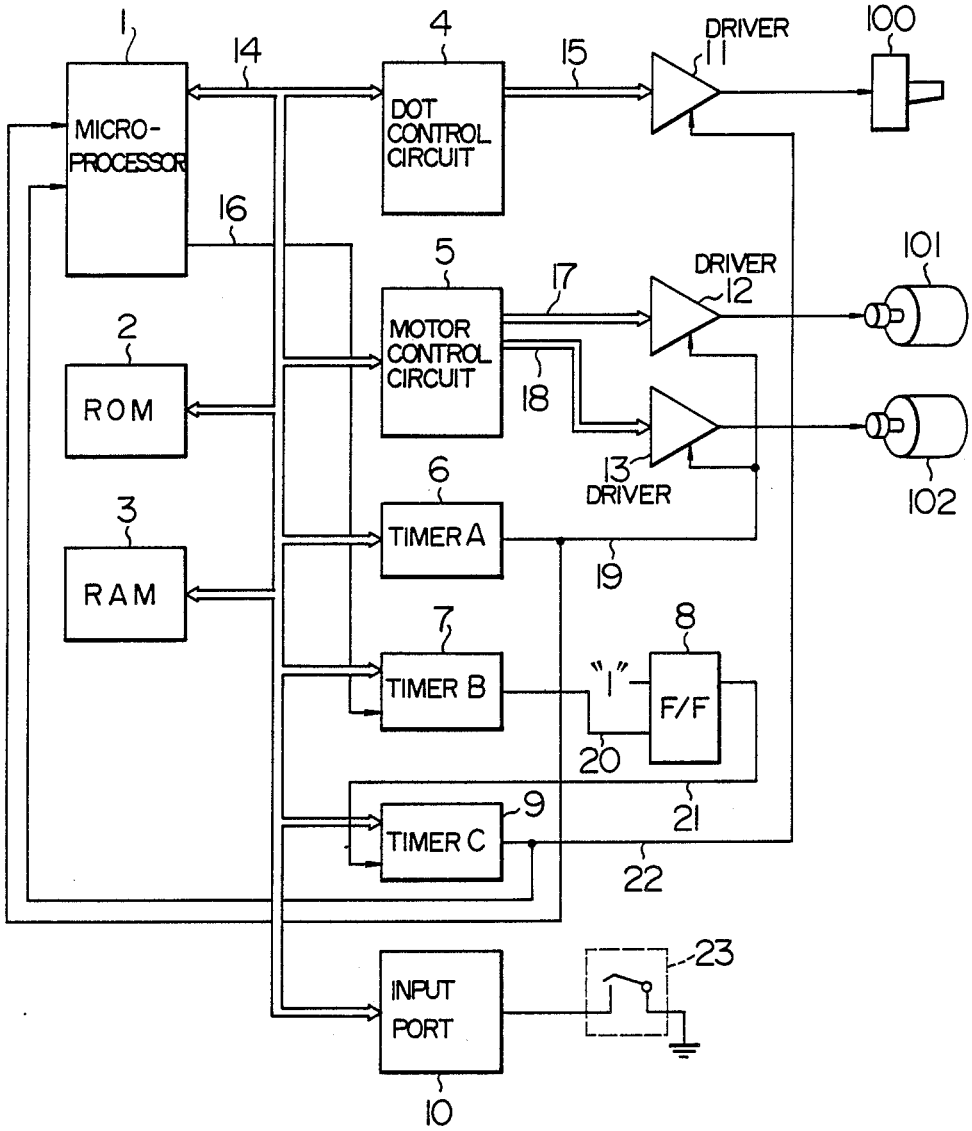
FIG. 1 is a schematic block diagram showing a printer control system according to an embodiment of the invention.

Referring first to FIG. 1, a printer control system comprises a microprocessor 1, a memory 2 which is a ROM for storing programs, a memory 3 which is a RAM used for storing print information and sensor information and for working various tables, a dot control circuit 4 for controlling a dot output signal to be supplied to a printing head 100, a motor control circuit 5 which controls a carriage motor 101 for conveying the printing head 100 in a print direction and a new-line start motor 102 for making the head 100 start a new line, a timer A, designated at 6, which produces a timing pulse signal 19 for controlling the motors, a timer B 7 which produces a pulse of a predetermined time width in timed relationship with the occurrence of "1" of an output signal 16 from the microprocessor 1, a flip-flop 8 which is set to "1" at the trailing edge of an output pulse 20 of the timer 7, a timer C 9 which follows setting of an output signal 21 to "1" to start counting time and produces a dot control timing pulse signal 22, an input port 10 for a program switch 23, a driver 11 for the printing head 100, a driver 12 for the carriage motor 101 for conveying the printing head, and a driver 13 for the new-line start motor 102. The ROM 2, RAM 3, dot control circuit 4, motor control circuit 5, timer A 6, timer B 7, timer C 9 and input port 10 are coupled to a bus 14 of the microprocessor 1. A dot data output signal 15 from the dot control circuit 4 is supplied to the driver 11 and phase data output signals 17 and 18 are supplied to the drivers 12 and 13, respectively. It will be appreciated that stepping motors are used as the motors 101 and 102 in this embodiment. The motor control timing pulse signal 19 delivered out of the timer A 6 and the dot control timing pulse signal 22 delivered out of the timer C 9 are both supplied to the microprocessor 1 so that timings for delivery of the phase data output signals to the motors and of the dot data output signal to the head may be managed by the microprocessor. In advance of commencement of printing, the output signal 16 from the microprocessor 1 is set to "1" in synchronism with the timing for motor control.

Thus, this embodiment includes the feature that the output signal 16 delivered out of the microprocessor 1 to start printing is transmitted to the timer C 9 with a predetermined time delay which is determined by the timer B 7 and flip-flop 8. Another feature resides in that the amount of time delay, i.e., the width of the output pulse signal 20 from the timer B 7 can be varied in accordance with set conditions of the program switch 23. More specifically, the timer B 7 is a programmable timer, and particular timer data is selected from a series of timer data described in a table 200 of FIG. 2 in accordance with a set condition of the program switch 23 and is set into the programmable timer prior to starting printing operation.

Figures 2, 3:
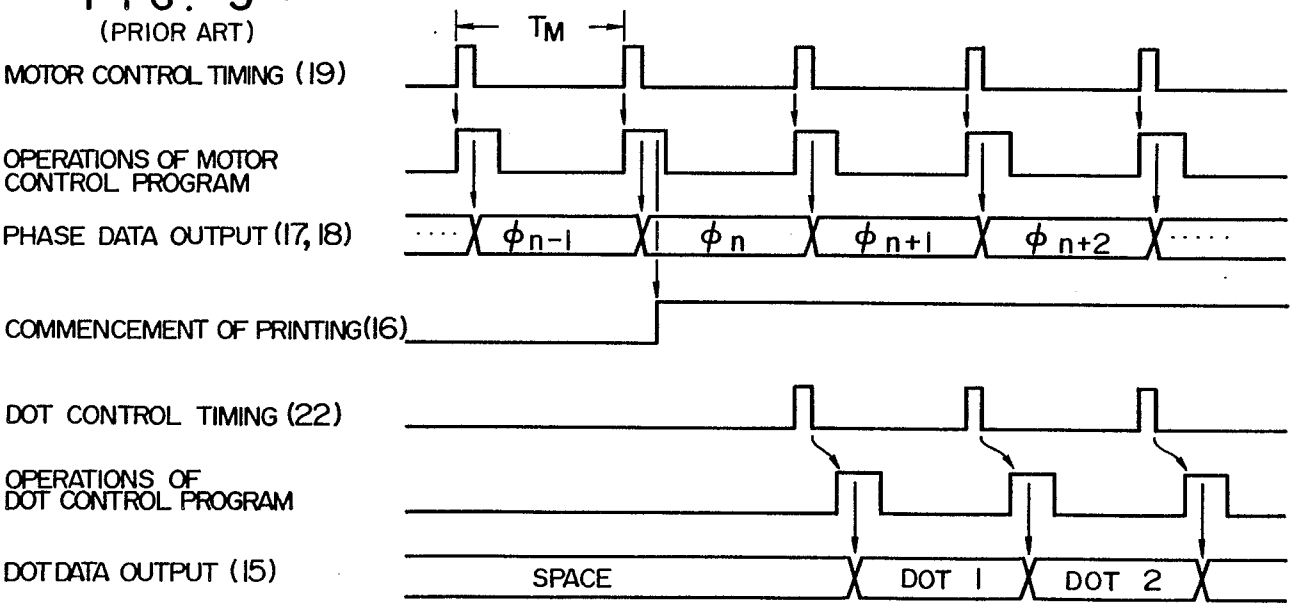
FIG. 3 (PRIOR ART)
FIG. 2 is a timer table.
FIG. 3 is a time chart illustrative of the conventional dot controlling.

FIG. 3 is a time chart in a positive directional printing or a negative directional printing illustrative of the conventional dot control timing and it indicates, from top to bottom, a motor control timing pulse signal 19, sequential operations of a motor control program started in timed relationship with the occurrence of respective pulses in the signal 19, a phase data output set into the motor control circuit 5 by the motor control program, a signal 16 for starting printing operation which is set to "1" by the motor control program when the printing head 100 is so decided through judgement by the motor control program that it has reached a printing position, a dot control timing pulse signal 22 resulting from ANDing the signal 16 and the motor control timing pulse signal 19, sequential operations of a dot control program started on the basis of the occurrence of pulses in the signal 22, and a dot data output signal 15 at the bottom. Since in the conventional controlling the motor control timing is timed with the dot control timing, the printing commencement position is controlled by counting the number of steps by which the stepping motor 101 is advanced with the result that the printing position is changed solely in unit of dot pitch.

Figure 4:
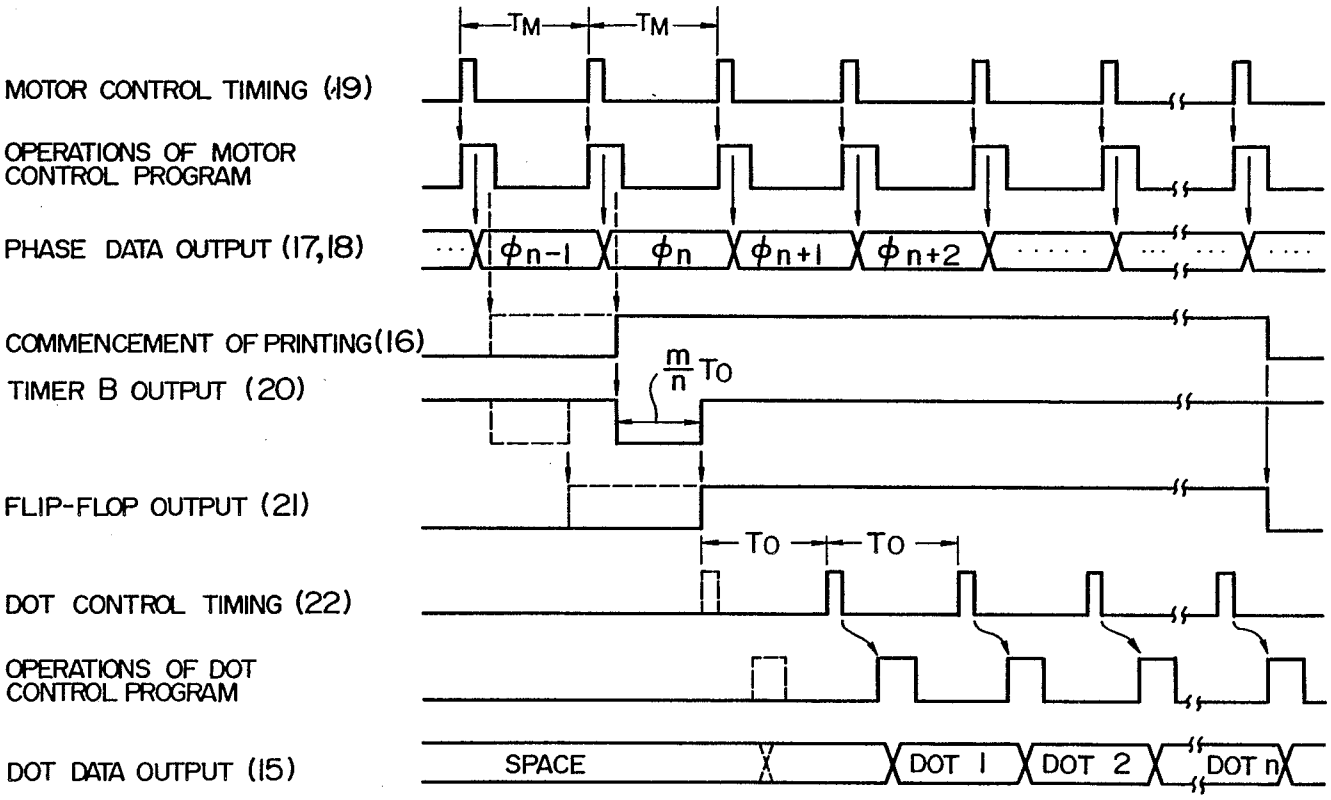
FIG. 4 is a time chart illustrative of dot controlling in accordance with the present invention.

Dot controlling according to this embodiment of the invention in contrast to the conventional one is seen from a dot control timing chart in a positive directional printing or a negative directional printing shown in FIG. 4. This time chart indicates the top to fourth waveforms which are identical to those of FIG. 3 and it further indicates, from the fifth line to the bottom, an output pulse signal 20 delivered out of the timer B 7 in timed relationship with the setting of the signal 16 for printing commencement to "1", an output signal 21 from flip-flop 8 which is set to "1" at the trailing edge of the pulse signal 20, a dot control timing pulse signal 22 delivered out of the timer C 9 which starts counting time in response to a timing that the output signal 21 of the flip-flop 8 rises to "1", sequential operations of a dot control program started on the basis of the occurrence of the pulses in the signal 22, and a dot data output signal 15 at the bottom. As is clear from the time chart of FIG. 4, the dot control timing can be set independently of the motor control timing in accordance with this embodiment of the invention. Specifically, the width of the output pulse signal 20 from the timer B 7 is set to m $T_O/n$, where m=0 ... (n-1), by dividing the period $T_O$ of the dot control timing pulse by n and multiplying the resulting $T_O/n$ by a value of m selected from the timer table 200 stored in the ROM 2 in accordance with a set condition of the program switch 23. Thus, the dot output timing can be retarded controllably to change the printing position slightly. Where the number of bits of the program switch is a, n is set to be $2^a$. For example, for a=2, n equals 4 and the value of m set by the program switch 23 is 0 (zero) with OFF and OFF, 1 (one) with ON and OFF, 2 with OFF and ON, and 3 with ON and ON.

Figure 5:
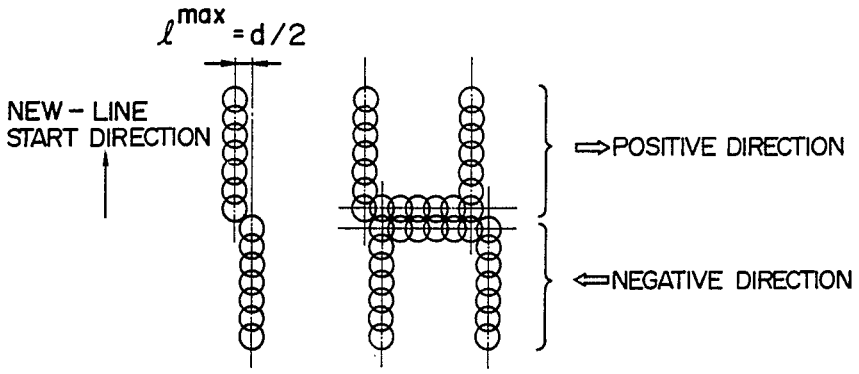
FIGS. 5 to 7 illustrate examples of printed letters.
Figure 6:
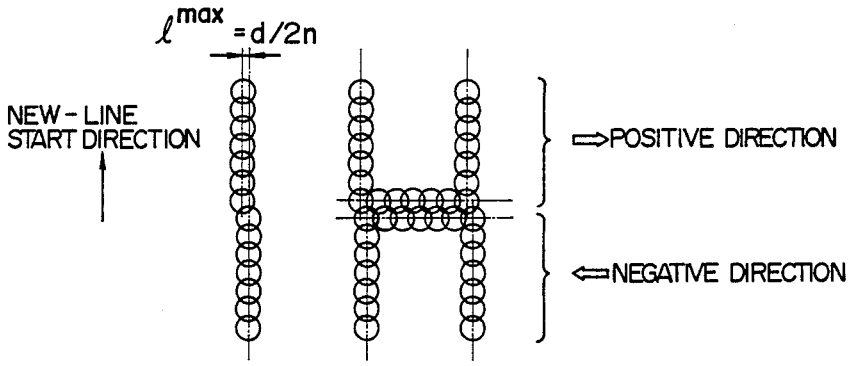
Figure 7:
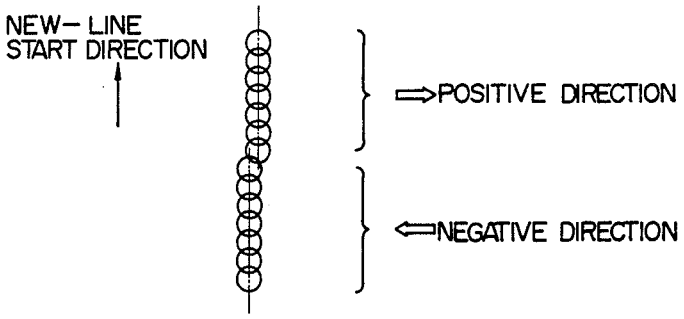

Since the amount of misalignment due to the mechanical factor taking place during the bidirectional printing is inherent to a system used, the program switch 23 is set for fine correction of the printing position such that accuracy of alignment between portions of a vertical rule and/or a vertically enlarged letter is optimized when these portions are printed bidirectionally. FIG. 5 shows an example of conventional prints in comparison with a similar example of prints according to this embodiment of the invention and shown in FIG. 6. Particularly, the prints exemplified in FIGS. 5 and 6 are a vertical rule and a vertically enlarged letter "H" which are printed bidirectionally. Given an amount of misalignment l during the bidirectional printing, the misalignment l after correction is half the dot pitch d/2 at the minimum in the conventional prints but in contrast, the misalignment l after correction can be d/2n at the minimum in the prints of this embodiment by retarding the timing for commencement of printing in the positive or negative direction by m $T_O/n$. The value m of the program switch may preferably be set such that m/n approximates l/d. In this manner, the misalignment between portions printed bidirectionally can be corrected to the minimal d/2n according to this embodiment, in contrast to the conventional system wherein the misalignment can not be corrected to less than half the dot pitch. In FIGS. 5 and 6, the direction of misalignment is exemplified such that the printing position of a portion on a line to be printed in the positive direction is displaced toward the negative direction. If the direction of misalignment is such that the printing position of a portion on a line to be printed in the positive direction is displaced toward the positive direction as illustrated in FIG. 7, then the timing for commencement of printing will be accelerated as shown at dotted line illustration in FIG. 4. To this end, several bits of the program switch 23 are reserved for correction in a unit of dot pitch. Although it has been explained that the timing for commencement of printing in the positive or negative direction is retarded, the timing for commencement of printing in both the directions may be retarded to obtain a predetermined amount of retardation.

As described above, according to the invention, the misalignment during the bidirectional printing with a dot serial printer can be reduced, to ensure that sufficiently high print quality can be obtained even when bidirectional printing for documents containing vertical rules and/or vertically enlarged letters is performed, thereby promoting throughput to 1.5 to 2 times the throughput of the conventional system in which portions on lines are printed unidirectionally.

I claim:

1. A dot serial printer for bidirectional printing of letters and the like comprising:

first means for producing motor control timing pulse signals for controlling a carriage motor;

second means for producing a signal indicative of printing in synchronism with the motor control timing pulse signals;

third means for delaying the signals indicative of commencement of printing by m/n times a dot drive period, where m and n are positive integers and n > m so as to produce a delayed signal; and fourth means for producing dot control timing pulse signals in response to the delayed signal independently of the motor control timing pulse signals, a period of the dot control timing pulse signals being independent of a period of the motor control timing pulse signals.

2. A dot serial printer according to claim 1, further comprising fifth means for making the value of m/n variable.

* * * * *